US008363851B2

(12) United States Patent
Suzuki

(10) Patent No.: US 8,363,851 B2
(45) Date of Patent: Jan. 29, 2013

(54) SPEAKER ARRAY APPARATUS FOR FORMING SURROUND SOUND FIELD BASED ON DETECTED LISTENING POSITION AND STORED INSTALLATION POSITION INFORMATION

(75) Inventor: Koji Suzuki, Iwata (JP)

(73) Assignee: Yamaha Corporation (JP)

( * ) Notice: Subject to any disclaimer, the term of this patent is extended or adjusted under 35 U.S.C. 154(b) by 1088 days.

(21) Appl. No.: 12/178,070

(22) Filed: Jul. 23, 2008

(65) Prior Publication Data

US 2009/0028358 A1 Jan. 29, 2009

(30) Foreign Application Priority Data

Jul. 23, 2007 (JP) ..... 2007-190835

(51) Int. Cl.
*H04R 1/40* (2006.01)

(52) U.S. Cl. ..... 381/97; 381/300

(58) Field of Classification Search ..... 381/59, 381/97, 300, 1, 17, 18, 80, 81, 303–308
See application file for complete search history.

(56) References Cited

U.S. PATENT DOCUMENTS 4,882,753 A * 11/1989 Shivers ..... 381/307
5,440,639 A 8/1995 Suzuki et al.
5,666,425 A 9/1997 Sibbald et al.
5,761,315 A 6/1998 Iida et al.
5,999,630 A 12/1999 Iwamatsu
7,130,430 B2 10/2006 Milsap
7,561,706 B2 7/2009 Holmi et al.
7,577,260 B1 8/2009 Hooley et al.
7,929,709 B2 4/2011 Katayama
8,041,060 B2 10/2011 Takumai
8,223,992 B2 * 7/2012 Suzuki et al. ..... 381/97
2003/0026441 A1 2/2003 Faller
2005/0117753 A1 6/2005 Miura et al.

(Continued)

FOREIGN PATENT DOCUMENTS

EP 0637191 A2 2/1995
EP 1760920 A1 3/2007

(Continued)

OTHER PUBLICATIONS

Japanese Office Action for Corresponding Patent Application No. 2007-190835 issued Jul. 28, 2009—"Notification of Reasons for Refusal".

(Continued)

*Primary Examiner* — Kimberly Rizkallah
*Assistant Examiner* — Duy T Nguyen
(74) *Attorney, Agent, or Firm* — Rossi, Kimms & McDowell, LLP

(57) ABSTRACT

A speaker array apparatus includes a speaker array in which a plurality of speaker units are arranged, a storage section that stores installation position information of the speaker array, a position detecting section that detects a listening position of a listener, and a phase controlling section that controls phases of sounds to be emitted from the speaker units so that the speaker array emits sound beams of a plurality of channels. The phase controlling section controls the phases of the sounds on the basis of the installation position information and the listening position of the listener so that the speaker array emits the sound beams of the plurality of channels to form a surround sound field at the listening position of the listener.

1 Claim, 7 Drawing Sheets

U.S. PATENT DOCUMENTS

| | | | | |
|---|---|---|---|---|
| 2005/0117762 | A1 | 6/2005 | Sakurai et al. | |
| 2006/0126878 | A1 | 6/2006 | Takumai et al. | |
| 2006/0210101 | A1* | 9/2006 | Ishibashi et al. | 381/300 |
| 2006/0269070 | A1 | 11/2006 | Miura et al. | |
| 2007/0030976 | A1 | 2/2007 | Konagai | |
| 2007/0217621 | A1 | 9/2007 | Takumai | |
| 2007/0230724 | A1 | 10/2007 | Konagai et al. | |
| 2007/0286427 | A1 | 12/2007 | Jung et al. | |
| 2008/0101631 | A1 | 5/2008 | Jung et al. | |
| 2008/0165979 | A1* | 7/2008 | Takumai | 381/59 |
| 2008/0226084 | A1 | 9/2008 | Konagai et al. | |
| 2008/0273721 | A1 | 11/2008 | Walsh | |
| 2009/0010455 | A1 | 1/2009 | Suzuki et al. | |
| 2010/0189267 | A1 | 7/2010 | Konagai et al. | |

FOREIGN PATENT DOCUMENTS

| | | | |
|---|---|---|---|
| JP | 57-023691 | A | 2/1982 |
| JP | 06-133399 | A | 5/1994 |
| JP | 8-051698 | A | 2/1996 |
| JP | 8-146974 | A | 6/1996 |
| JP | 9-046800 | A | 2/1997 |
| JP | 09-233599 | A | 9/1997 |
| JP | 2966181 | B2 | 8/1999 |
| JP | 2000-295698 | A | 10/2000 |
| JP | 3205625 | B2 | 6/2001 |
| JP | 2005-012765 | A | 1/2005 |
| JP | 2005-167612 | A | 6/2005 |
| JP | 2005-286828 | A | 10/2005 |
| JP | 2006-013711 | A | 1/2006 |
| JP | 2006-60610 | A | 3/2006 |
| JP | 2006-067218 | A | 3/2006 |
| JP | 2006-114945 | A | 4/2006 |
| JP | 2006-238155 | A | 9/2006 |
| JP | 2006-246310 | A | 9/2006 |
| JP | 2006258442 | A | 9/2006 |
| JP | 2006-303658 | A | 11/2006 |
| JP | 2006-313980 | A | 11/2006 |
| JP | 2006-340302 | A | 12/2006 |
| JP | 2006-340306 | A | 12/2006 |
| JP | 2007-049413 | A | 2/2007 |
| JP | 2007-068000 | A | 3/2007 |
| JP | 2007-110744 | A | 4/2007 |
| JP | 2008-227803 | A | 9/2008 |
| WO | 2006001272 | A1 | 1/2006 |
| WO | WO2006001272 | * | 1/2006 |

OTHER PUBLICATIONS

Extended European Search Report for EP 10000889.5, mail date Jun. 11, 2010.

Extended European Search Report for EP 08004585.9, mail date Oct. 22, 2009.

Notification of Reasons for Refusal for JP 2007-061574, mail date Jan. 6, 2009.

Notification of Reasons for Refusal for JP 2007-061574, drafting date Apr. 17, 2009.

Japanese Office Action for corresponding JP 2007-175489, dated Jul. 23, 2009. Cited in co-pending application US 2009-0010455. English translation provided.

Co-Pending application US 2009-0010455, Specification with claims and drawings.

* cited by examiner

SPEAKER ARRAY APPARATUS FOR FORMING SURROUND SOUND FIELD BASED ON DETECTED LISTENING POSITION AND STORED INSTALLATION POSITION INFORMATION

BACKGROUND

The present invention relates to a speaker array apparatus for a surround system.

As a conventional speaker array apparatus, there is a sound reproducing apparatus into which, in order to set the emission directions of sound beams, the size of a room, the distance to the listening position, and the like are input, and which, on the basis of the values, sets the emission angles of sound beams, the path distances, etc. (see Patent Reference 1).

Moreover, there is a speaker array apparatus which sweeps test sound beams, picks up direct and reflected sounds of the sound beams by means of a microphone installed at a listening position, and analyzes the picked-up sound data to set the emission angles of sound beams, etc. (see Patent Reference 2).

[Patent Reference 1] JP-A-2006-60610

[Patent Reference 2] JP-A-2006-340302

In a conventional speaker array apparatus, when the listening position is changed after setting of the emission angles of sound beams, or the like, it is necessary to again input the distance to the changed listening position or again perform the test in order to change the emission directions of sound beams.

SUMMARY

It is an object of the invention to provide a speaker array apparatus for a surround system in which, even when the listening position is changed, the emission directions of sound beams can be easily changed.

In the invention, the apparatus comprises the following configurations as means for solving the problem.

(1) speaker array apparatus, comprising:

a speaker array in which a plurality of speaker units are arranged;

a storage section that stores installation position information of the speaker array;

a position detecting section that detects a listening position of a listener; and a phase controlling section that controls phases of sounds to be emitted from the speaker units so that the speaker array emits sound beams of a plurality of channels, wherein the phase controlling section controls the phases of the sounds on the basis of the installation position information and the listening position of the listener so that the speaker array emits the sound beams of the plurality of channels to form a surround sound field at the listening position of the listener.

According to the configuration, in the speaker array apparatus, the installation position information such as information of the size of a room where the speaker array is installed, and the distance from a wall of the room to the speaker array is stored in the storage section. When the position detecting section outputs the installation position information which is information of the position of the listener with respect to the speaker array, the phase controlling section calculates the phases of sounds to be emitted from the plurality of speaker units of the speaker array, on the basis of the installation position information. Based on a result of the calculation, the phase controlling section controls the phases of sounds to be emitted from the speaker units, and the plurality of sound beams of channels are emitted from the speaker array toward the listening position. In the speaker array apparatus, when the listener changes the listening position, the position detecting section outputs information of the detected listening position, whereby the phases of the sound beams can be controlled and an adequate surround sound field can be formed at the listening position.

(2) The apparatus further comprises:

an operating section that receives a position setting operation for storing the installation position information of the speaker array into the storage section;

a test sound outputting section that outputs a test sound signal and a phase control signal so that the speaker array emits a test sound beam while sweeping the test sound beams, when the operating section receives the position setting operation;

a microphone that is installed at a default listening position, and that picks up a sound of the test sound beam; and a controlling section that analyzes picked-up data of the test sound beams picked up by the microphone, calculates the installation position information of the speaker array by using a result of the analysis of the picked-up data and the listening position information, and stores the installation position information of the speaker array into the storage section.

According to the configuration, in the speaker array apparatus, when the operating section receives the installation position setting operation, the speaker array emits the test sound beams while sweeping the emitted beams. Direct and reflected sounds of the test sound beams are picked up by the microphone installed at the default listening position, and the controlling section analyzes the picked-up data, calculates the installation position information, and stores the information into the storage section. Even when the installation position information of the speaker array is not input, the listener can cause the speaker array apparatus to automatically set information of the installation position.

In the speaker array apparatus of the invention, when the listener changes the listening position, the position detecting section detects the listening position, a calculation is performed on the basis of the listening position information, and the phases of sounds to be emitted from the speaker units of the speaker array are controlled so that sound beams of channels are emitted toward the changed listening position directly and indirectly. Therefore, an adequate surround sound field can be formed at the listening position. As a result, the listener can enjoy surround sounds at a preferred listening position without concern for the change of the listening position.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
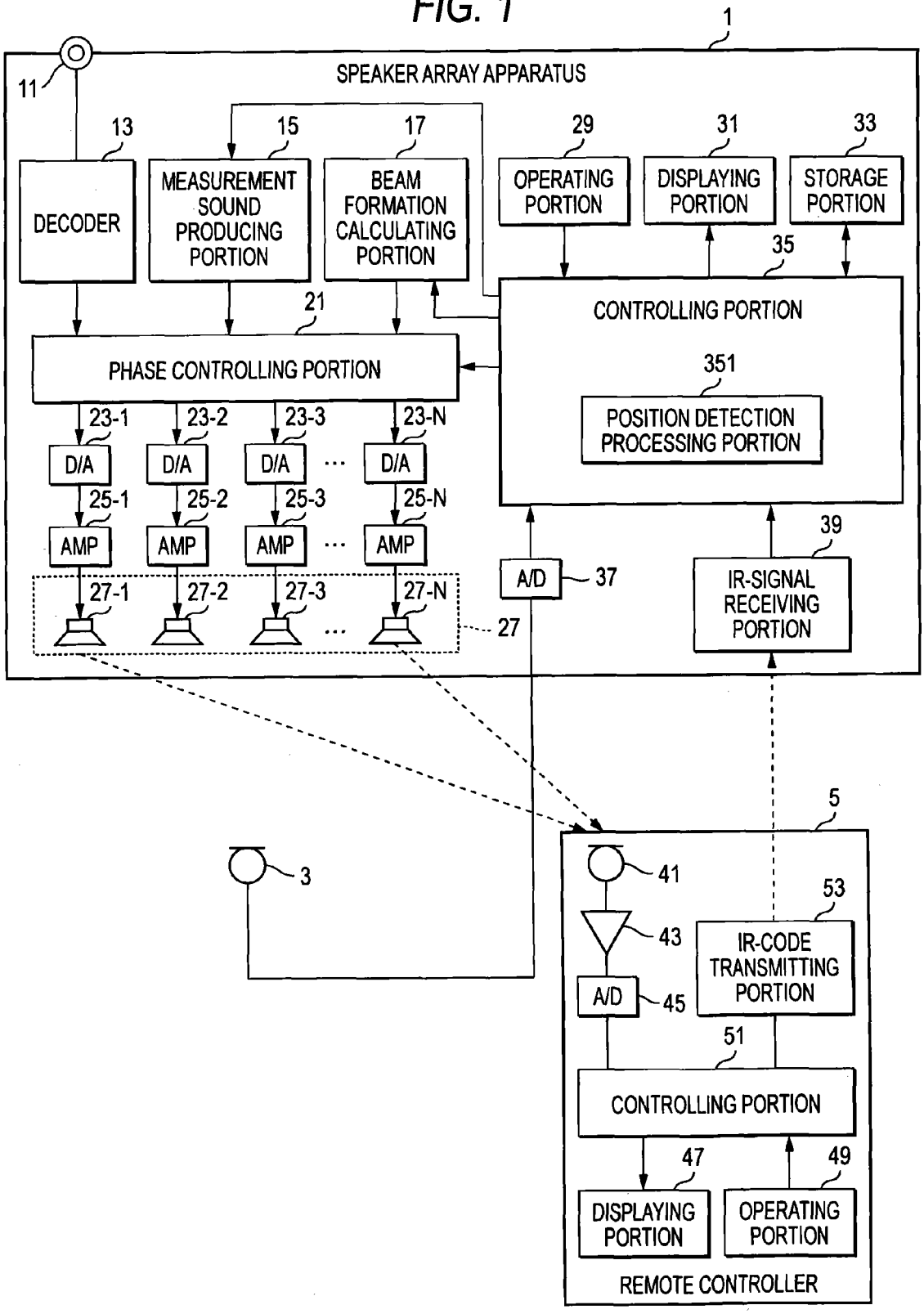
FIG. 1 is a block diagram schematically showing the configuration of a speaker array apparatus of an embodiment of the invention.

FIG. 1 is a block diagram schematically showing the configuration of a speaker array apparatus of an embodiment of the invention. Hereinafter, a speaker array apparatus for a 5-ch surround system will be exemplarily described.

First, the configuration of the speaker array apparatus 1 will be specifically described. As shown in FIG. 1, the speaker array apparatus 1 comprises an input terminal 11, a decoder 13, a measurement sound producing portion 15, a beam formation calculating portion 17, a phase controlling portion 21, D/A converters 23-1 to 23-N, power amplifiers 25-1 to 25-N, a speaker array 27 consisting of speaker units 27-1 to 27-N, an operating portion 29, a displaying portion 31, a storage portion 33, a controlling portion 35 having a position detection processing portion 351, an A/D converter 37, and an IR-signal receiving portion 39.

The input terminal 11 is connected to an external audio apparatus (not shown) to receive a digital surround sound signal output from the external audio apparatus.

The decoder 13 decodes the digital surround sound signal supplied through the input terminal 11 to 5-channel sound signals, and supplies the signals to the phase controlling portion 21.

In accordance with output instructions from the controlling portion 35, the measurement sound producing portion 15 supplies a test sound signal (a non-periodic narrow band sound wave which is centered at 4 kHz, or a sound wave which has no periodicity, such as white noises), or a test pulse signal (an impulse signal or a signal with short white noises), to the phase controlling portion 21.

In order to form a surround sound field due to sound beams in the periphery of the listener, the beam formation calculating portion 17 performs a calculation for delaying by a required amount the sound signals of the channels which are to be distributed to a part or all of the D/A converters 23-1 to 23-N, and supplies a result of the calculation to the phase controlling portion 21.

The phase controlling portion 21 controls the phases of sound signals to be distributed to a part or all of the D/A converters 23-1 to 23-N, on the basis of the calculation result supplied from the beam formation calculating portion 17 and instructions from the controlling portion 35. When the test sound signal supplied from the measurement sound producing portion 15 is distributed to the D/A converters 23-1 to 23-N, furthermore, the phase controlling portion 21 controls the phase of the test sound signal on the basis of instructions from the controlling portion 35. The phase controlling portion 21 outputs the test pulse signal supplied from the measurement sound producing portion 15, to the D/A converters 23-1 and 23-N on the basis of instructions from the controlling portion 35.

The D/A converters 23-1 to 23-N convert the digital sound signal supplied from the phase controlling portion 21 to an analog sound signal, and output the analog sound signal.

The power amplifiers 25-1 to 25-N amplify and output the analog sound signals supplied from the D/A converters 23-1 to 23-N.

In the speaker array 27, the speaker units 27-1 to 27-N are placed on one panel in a predetermined arrangement such as a matrix pattern, a linear pattern, or a honeycomb pattern. The speaker units 27-1 to 27-N convert the sound signals which are amplified by the power amplifiers 25-1 to 25-N, to sounds, and emit the sounds.

The operating portion 29 receives a setting operation or the like which is applied to the speaker array apparatus 1 by the listener, and outputs a signal corresponding to the operation, to the controlling portion 35.

The displaying portion 31 displays information to be transmitted to the listener, on the basis of a control signal supplied from the controlling portion 35.

The storage portion 33 stores installation position information of the speaker array 27, listening position information of the listener, the set pattern of the speakers, and the like data, and reads out data corresponding to an operation which is received by the controlling portion 35 through the operating portion 29. The storage portion 33 temporarily stores sound data picked up by a microphone 3.

The controlling portion 35 controls various portions of the speaker array apparatus 1. The position detection processing portion 351 performs a process of detecting the positions of the microphone 3 and a remote controller 5.

The A/D converter 37 converts an analog sound signal supplied from the microphone 3 to a digital sound signal, and outputs the digital sound signal to the controlling portion 35.

The microphone 3 is omnidirectional, installed at the listening position of the listener in order to set a surround sound field when the speaker array apparatus 1 is installed at a listening place, and outputs a picked-up sound signal to the AND converter 37.

Upon receiving an IR (infrared) signal output from the remote controller 5, the IR-signal receiving portion 39 converts the signal to an electric signal, and then supplies the electric signal to the controlling portion 35.

The remote controller 5 is used for performing various operations on the speaker array apparatus 1.

The remote controller 5 comprises the microphone 41, an amplifier 43, an A/D converter 45, a displaying portion 47, an operating portion 49, a controlling portion 51, and an IR-code transmitting portion 53.

The microphone 41 is an omnidirectional microphone, picks up sounds propagated from the periphery, and outputs a sound signal to the amplifier 43.

The amplifier 43 amplifies the sound signal output from the microphone 41, and then supplies the signal to the A/D converter 45.

The A/D converter 45 converts (samples) the analog sound signal which is amplified by the amplifier 43, to a digital sound signal, and then outputs the digital sound signal to the controlling portion 51.

The displaying portion 47 displays messages indicative of an executed mode, an error, etc.

The operating portion 49 receives an operation performed by the listener.

The controlling portion 51 controls various portions of the remote controller 5.

The IR-code transmitting portion 53 outputs an IR (infrared) signal corresponding to a signal output from the controlling portion 51.

Figure 2:
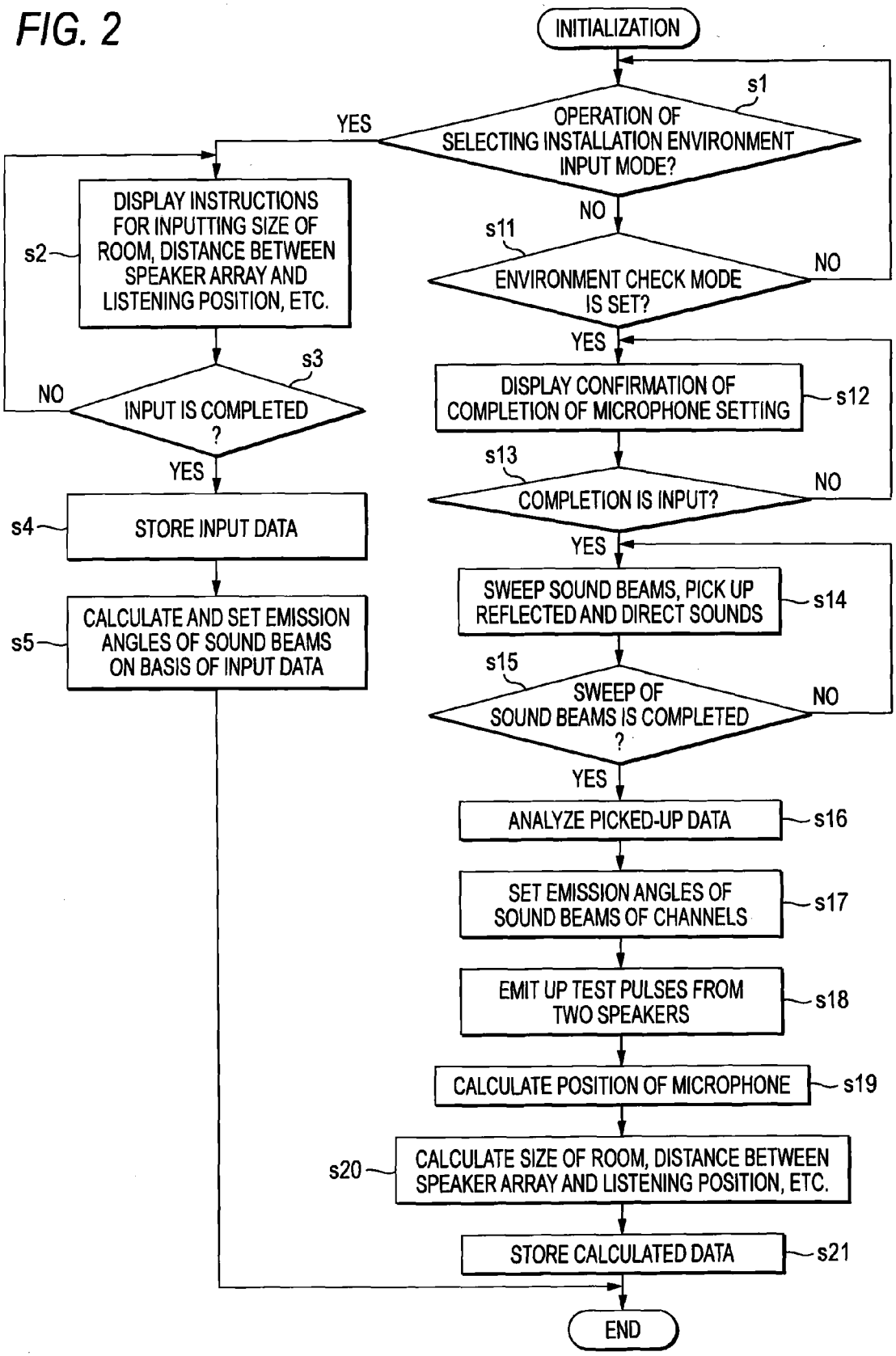
FIG. 2 is a flowchart illustrating the operation of initialization of the speaker array apparatus.
Figure 3A:
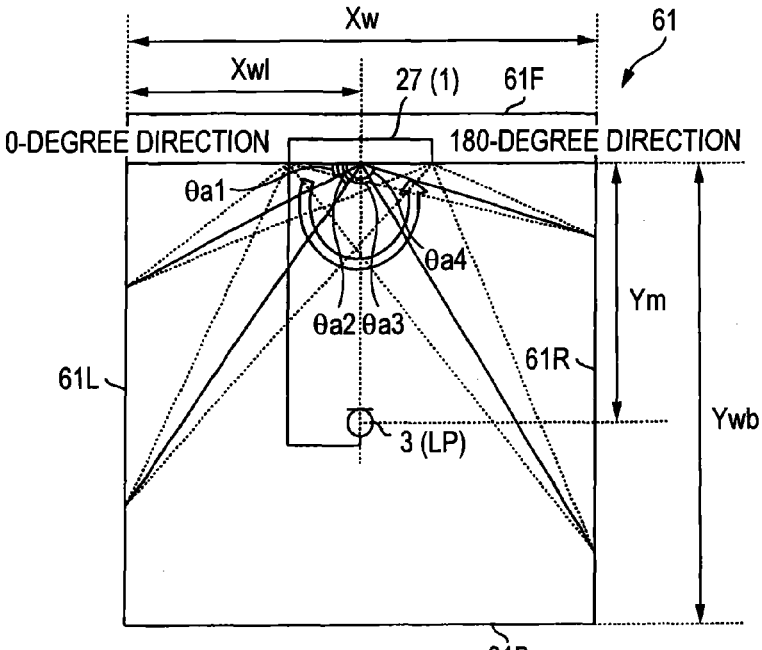
FIGS. 3A to 3C are views illustrating the procedure of setting the emission directions of sound beams in the case where the speaker array apparatus is wall-installed.
Figure 3B:
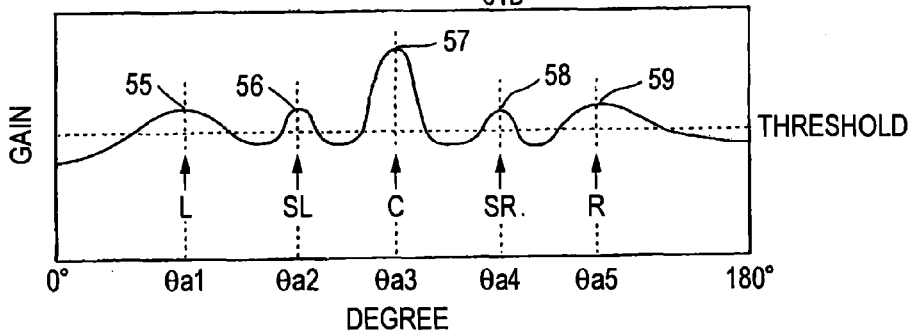
Figure 3C:
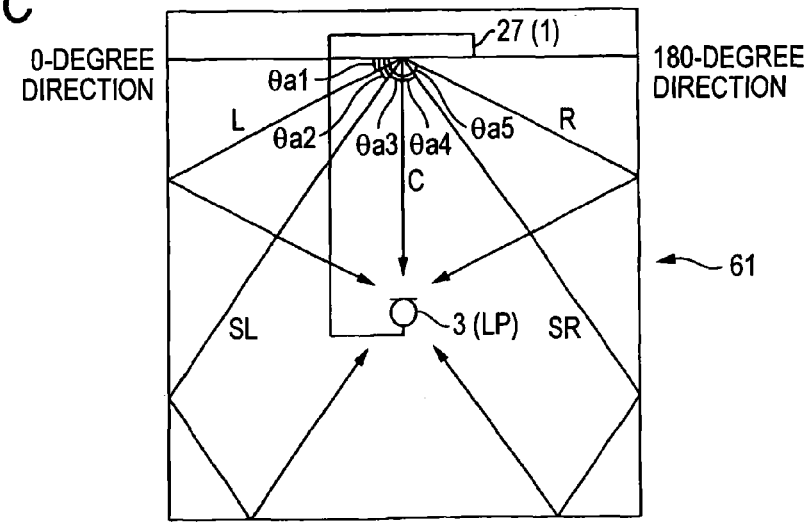
Figure 4A:
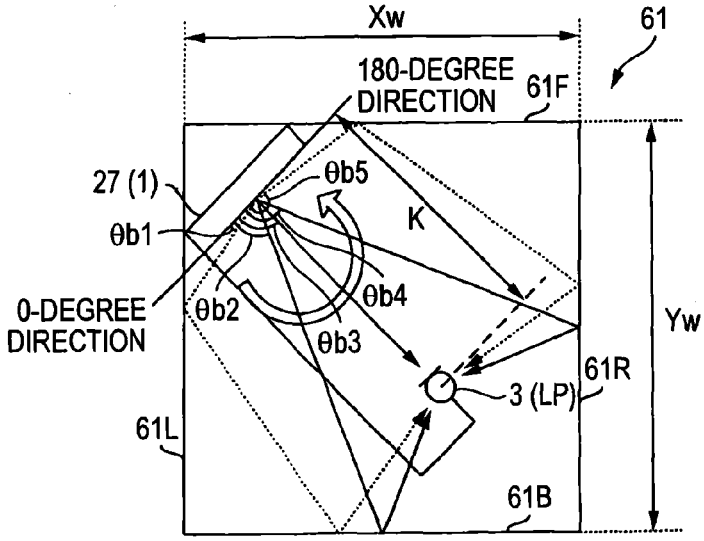
FIGS. 4A to 4C are views illustrating the procedure of setting the emission directions of sound beams in the case where the speaker array apparatus is corner-installed.
Figure 4B:
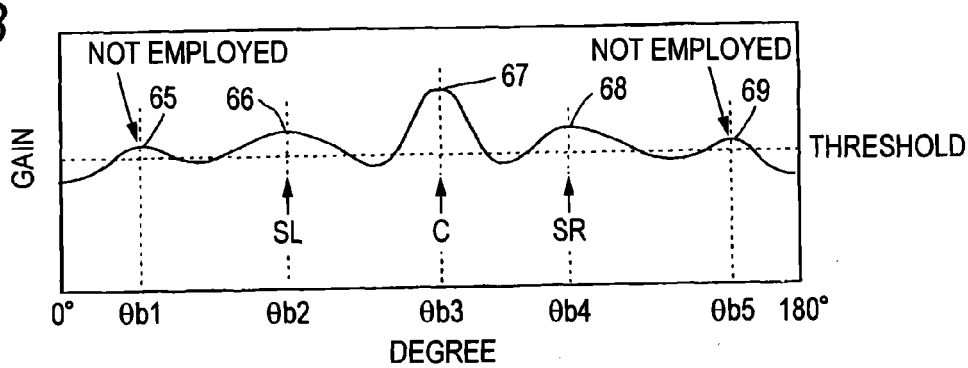
Figure 4C:
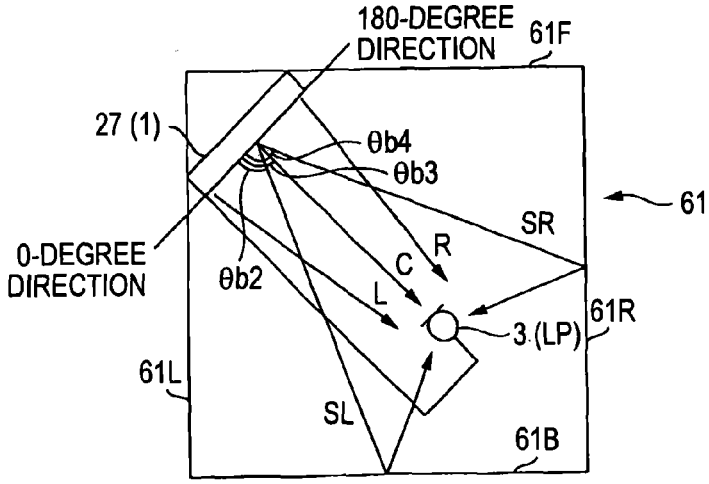
Figure 5A:
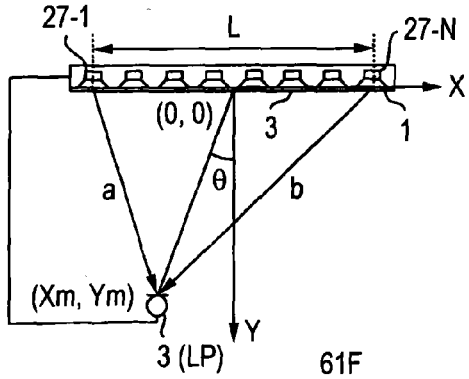
FIGS. 5A to 5C are views illustrating the procedure of obtaining the size of a room by calculation.
Figure 5B:
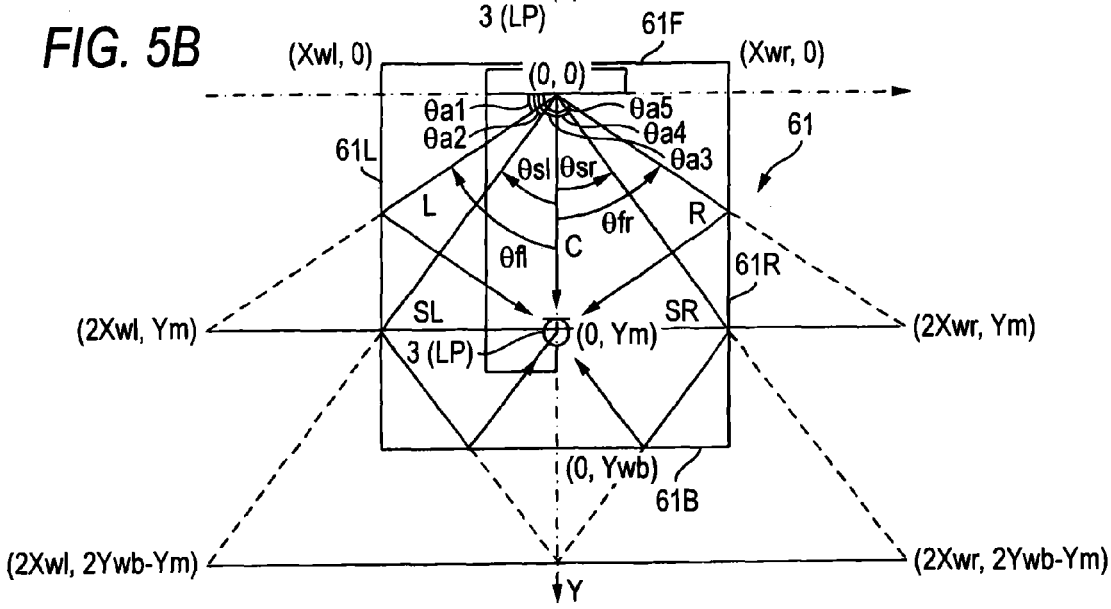
Figure 5C:
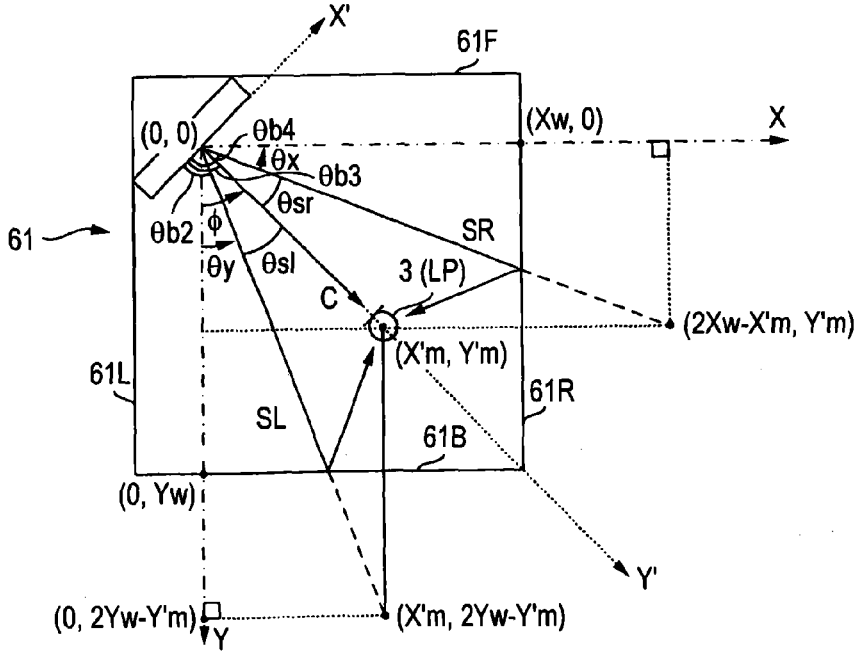

Next, the operation in the case where the speaker array apparatus 1 is installed will be described. FIG. 2 is a flowchart illustrating the operation of initialization of the speaker array apparatus. FIGS. 3A to 3C are views illustrating the procedure of setting the emission directions of sound beams in the case where the speaker array apparatus is wall-installed. FIGS. 4A to 4C are views illustrating the procedure of setting the emission directions of sound beams in the case where the speaker array apparatus is corner-installed. FIGS. 5A to 5C are views illustrating the procedure of obtaining the size of a room by calculation.

As shown in FIG. 3A, the speaker array apparatus 1 (the speaker array 27) is installed in the vicinity of the center of a front wall 61F of a room 61 and in parallel to the wall (hereinafter, this state is referred to as wall installation), or, as shown in FIG. 4A, the speaker array apparatus is installed in a corner of the room 61 with directing the sound emission surface of the speaker array 27 toward the center of the room 61 (hereinafter, this state is referred to as corner installation).

When initialization is to be performed by inputting the size of the room and the like, the listener operates the operating portion 29 of the speaker array apparatus 1 to select an installation environment input mode. When it is detected that the operating portion 29 is operated and the installation environment input mode is selected (s1: Y), the controlling portion 35 controls the displaying portion 31 so as to display contents instructing inputs of the installation position (wall installation or corner installation), the width and depth of the room, and the distance from the sound emission surface of the speaker array 27 to the listening position LP (s2).

In the case where the speaker array apparatus 1 is wall-installed as shown in FIG. 3A, the listener inputs the distance Ywb from the sound emission surface of the speaker array 27 to a rear wall 61B, the lateral width (the distance between a left wall 61L and a right wall 61R) Xw of the room, the distance Xwl between the center of the speaker array 27 and the left wall 61L, and the distance Ym from the sound emission surface of the speaker array 27 to the listening position LP. In the case where the speaker array apparatus 1 is corner-installed as shown in FIG. 4A, the listener inputs the lateral width (the distance between the left wall 61L and the right wall 61R) Xw of the room 61, the depth (the distance between the front wall 61F and the rear wall 61B) Yw of the room 61, and the distance K from the sound emission surface of the speaker array 27 to the microphone 3.

The controlling portion 35 waits until setting and values are input through the operating portion 29 (s3: N). When it is detected that the input is completed (s3: Y), the storage portion 33 stores these input data (s4). The controlling portion 35 controls the beam formation calculating portion 17 so as to perform a calculation for controlling emission directions (phases) of sound beams of channels (s5). Then, the controlling portion 35 ends the initialization process.

By contrast, when initialization of the installation environment and the like is to be automatically performed, the listener operates the operating portion 29 of the speaker array apparatus 1 to select an environment check mode (position setting operation). When it is detected that the operating portion 29 is operated and the environment check mode is selected (s1: N, s11: Y), the controlling portion 35 displays contents instructing that the microphone 3 is installed at the default listening position LP, and, after installation, information indicative of completion is input, on the displaying portion 31 (s12).

In accordance with the instructions, the listener installs the microphone 3 in front of the sound emission surface of the speaker array 27, and operates the operating portion 29 to input completion.

When the input of completion is detected (s13: Y), the controlling portion 35 supplies a control signal to the measurement sound producing portion 15 and the phase controlling portion 21 so as to sweep the sound beams between one direction which is parallel to the front face of the speaker array 27 (hereinafter, the direction is referred to as 0-degree direction) and the other direction which is parallel to the front face of the speaker array 27 (hereinafter, the direction is referred to as 180-degree direction). Sounds (indirect sounds) reflected from the wall and direct sounds from the speaker array 27 are picked up by the microphone 3, and picked-up sound data are stored into the storage portion 33 (s14).

As shown in FIGS. 3A and 4A, the sound beams are swept in front of the speaker array apparatus 1 and direct sounds of the sound beams and indirect sound reflected by the walls are picked up by the microphone 3. In the case where the sound beams advance toward the microphone 3, the gains of the sounds picked up by the microphone 3 are increased. By contrast, in the case where the sound beams advance in a direction different from the direction toward the microphone 3, the gains of the sounds picked up by the microphone 3 are decreased. In the speaker array apparatus 1, by using such characteristics, the sweep angle at which the gain has a peak value is obtained from the picked-up sound data, so that an angle optimal to output sound beams can be set.

The controlling portion 35 continues the sound pick-up until the sweep angle of the sound beams reaches 180 degrees, and stores the picked-up sound data into the storage portion 33 (s14, s15: N). When the sweep of the sound beams is completed (s15: Y), the picked-up sound data are read out from the storage portion 33, and states such as the peak number, the peak levels, and symmetry are analyzed (s16).

The controlling portion 35 sets sweep angles corresponding to peaks of the picked-up sound data, in the beam formation calculating portion 17 as sound emission angles of sounds beams of the channels so that the phase control of emissions of sound beams of the channels from the speaker array 27 is calculated (s17). In the case where plural peaks which are not lower than the threshold exist in the picked-up sound data, the controlling portion 35 sets the sweep angle of the peak which is in the adequate range, which has a width that is not smaller than a fixed value, and in which the gain level is highest, as the angle at which a C-ch sound beam is output. Furthermore, the controlling portion 35 selects and detects the number of peaks which exceed the gain threshold, in regions on the both sides of the peak that is set to C-ch, while excluding peaks which are excessively close to the C-ch peak, and which have an angle that are impractical under normal circumstances as an installation angle of a virtual speaker. When the peak numbers of the both sides of the C-ch peak are equal to each other, the controlling portion 35 allocates channels in the sequence of a surround channel and a front channel, to peaks in the order of the distance from the C-ch peak, and finds their angles.

The speaker array apparatus 1 is set so that, in the case of picked-up data shown in FIG. 3B, for example, a surround sound field is produced by the sound beams as shown in FIG. 3C, and, in the case of picked-up data shown in FIG. 4B, a surround sound field is produced as shown in FIG. 4C.

Then, the controlling portion 35 of the speaker array apparatus 1 outputs the control signal to the measurement sound producing portion 15 and the phase controlling portion 21 to cause the speaker units 27-1 and 27-N of the speaker array 27 to emit test pulses (s18). The position detection processing portion 351 measures times which elapse until the microphone 3 picks up the both test pulses, and calculates the position of the microphone 3 by the triangulation method using the times (s19).

In the case where, as shown in FIG. 5A, the distance from the speaker unit 27-1 to the microphone 3 is a, that from the speaker unit 27-N to the microphone 3 is b, and that between the speaker units 27-1 and 27-N is L, the installation position (Xm, Ym) of the microphone 3 is obtained by $$Xm=(a^2-b^2)/2L, Ym=\sqrt{\{a^2-(L/2+Xm)^2\}}, \text{ and}$$

$$\theta=\tan^{-1}(Xm/Ym).$$

In the case where, as shown in FIG. 5B, the microphone 3 is installed in front of the center of the speaker array apparatus 1 (the speaker array 27) which is wall-installed, therefore, a=b is attained, and hence the distance Ym from the speaker array 27 to the microphone 3 is obtained by $$Ym=\sqrt{\{a^2-(L/2)^2\}} \quad \text{(Exp. 1)}$$

Also in the case where, as shown in FIG. 5C, the apparatus is corner-installed, similarly, the distance K from the speaker array 27 to the microphone 3 is obtained by $$Y'm=X'm=\sqrt{\{a^2-(L/2)^2\}} \quad \text{(Exp. 2)}$$

Then, the controlling portion 35 calculates an approximate size (the width and the depth) of the room where the speaker array apparatus 1 is installed, and, in the case where the speaker array apparatus 1 is wall-installed, the distance from the right or left wall to the speaker array apparatus 1 (s20). In the case where the speaker array apparatus 1 is wall-installed, with using the sound emission angles θa1 to θa5 of the sound beams of the channels and the distance Ym from the speaker array 27 to the microphone 3, the controlling portion 35 calculates values as follows. In the case where the speaker array apparatus 1 is corner-installed, with using the sound emission angles θb2 to θb4 of the sound beams of the channels and the distance Y'm from the speaker array 27 to the microphone 3, the controlling portion 35 calculates values as follows.

In FIG. 5B, the center of the front face of the speaker array 27 is set as the origin (0, 0), an axis which passes through the origin, and which is parallel to the front face of the speaker array 27 is set as an X-axis, and an axis which passes through the origin, and which is perpendicular to the X-axis is set as a Y-axis. The distance from the origin to the left wall 61L is Xwl, that from the origin to the right wall 61R is Xwr, that from the origin to the rear wall 61B is Ywb, and that from the origin to the listening position is Ym. The angle formed by the Y-axis and the L-ch sound beam is indicated by θfl, that formed by the Y-axis and the SL-ch sound beam is indicated by θsl, that formed by the Y-axis and the R-ch sound beam is indicated by θfr, and that formed by the Y-axis and the SR-ch sound beam is indicated by θsr. In the case where the speaker array apparatus 1 is wall-installed, as shown in FIG. 5B, the followings are obtained:

$$\tan\theta fl=\tan(\theta a3-\theta a1)=(2Xwl/Ym) \quad \text{(Exp. 3)}$$

$$\tan\theta sl=\tan(\theta a3-\theta a2)=\{2Xwl/(2Ywb-Ym)\} \quad \text{(Exp. 4)}$$

$$\tan\theta fr=\tan(\theta a5-\theta a3)=(2Xwr/Ym) \quad \text{(Exp. 5)}$$

$$\tan\theta sr=\tan(\theta a4-\theta a3)=\{2Xwr/(2Ywb-Ym)\} \quad \text{(Exp. 6)}$$

From these Expressions 1 and 3 to 6, the distance Xwl from the speaker array 27 to the left wall 61L, the distance Xwr from the speaker array 27 to the right wall 61R, and the depth Ywb of the room are obtained as follows:

$$Xwl=f\sqrt{\{a^2-(L/2)^2\}}\cdot\{\tan(\theta a3-\theta a1)\}]/2,$$

$$Xwr=f\sqrt{\{a^2-(L/2)^2\}}\cdot\{\tan(\theta a5-\theta a3)\}]/2,$$

$$Ywb=f\sqrt{\{a^2-(L/2)^2\}}\cdot\{\tan(\theta a3-\theta a1)\}]/\{2\tan(\theta a3-\theta a2)\}+[\sqrt{\{a^2-(L/2)^2\}}]/2.$$

The width Xw of the room is Xw=Xwl+Xwr.

In FIG. 5C, the center of the front face of the speaker array 27 is set as the origin, an axis which passes through the origin, and which is parallel to the front wall of the room is set as an X-axis, and an axis which passes through the origin, and which is parallel to the left wall is set as a Y-axis. An axis which passes through the origin, and which is parallel to the front face of the speaker array 27 is set as an X'-axis, and an axis which passes through the origin, and which is perpendicular to the X'-axis is set as a Y'-axis. The distance from the origin to the right wall 61R is Xw, that from the origin to the rear wall 61B is Yw, and the coordinates of the listening position with respect to the origin are (X'm, Y'm). The angle formed by the Y-axis and the SL-ch sound beam is indicated by θy, the angle ϕ formed by the Y-axis and the Y'-axis is ϕ=45°, the angle formed by the X-axis and the SR-ch sound beam is indicated by θx, that formed by the Y'-axis and the SL-ch sound beam is indicated by θsl, and that formed by the Y'-axis and the SR-ch sound beam is indicated by θsr. In the case where the speaker array apparatus 1 is corner-installed, as shown in FIG. 5C, the followings are obtained:

$$\tan\theta x=\tan(45°-\theta sr)=\tan\{45°-(\theta b4-\theta b3)\}=Y'm/(2Xw-X'm) \quad \text{(Exp. 7)},$$

$$\tan\theta y=\tan(45°-\theta sl)=\tan\{45°-(\theta b3-\theta b2)\}=X'm/(2Yw-Y'm) \quad \text{(Exp. 8)}.$$

From Expressions 2, 7, and 8, therefore, the followings are obtained:

$$Xw=1/2\cdot\sqrt{\{a^2-(L/2)^2\}}\cdot[1-1/\tan\{45°-(\theta b4-\theta b3)\}],$$

$$Yw=1/2\sqrt{\{a^2-(L/2)^2\}}\cdot[1-1/\tan\{45°-(\theta b3-\theta b2)\}].$$

As a result, the width and depth of the room 61 can be calculated.

When the controlling portion 35 calculates the width and depth of the room 61 and the distance from the left wall 61L to the speaker array 27 as described above, the controlling portion stores these values into the storage portion 33 (s21). Then, the controlling portion 35 ends the initialization process.

Figure 6:
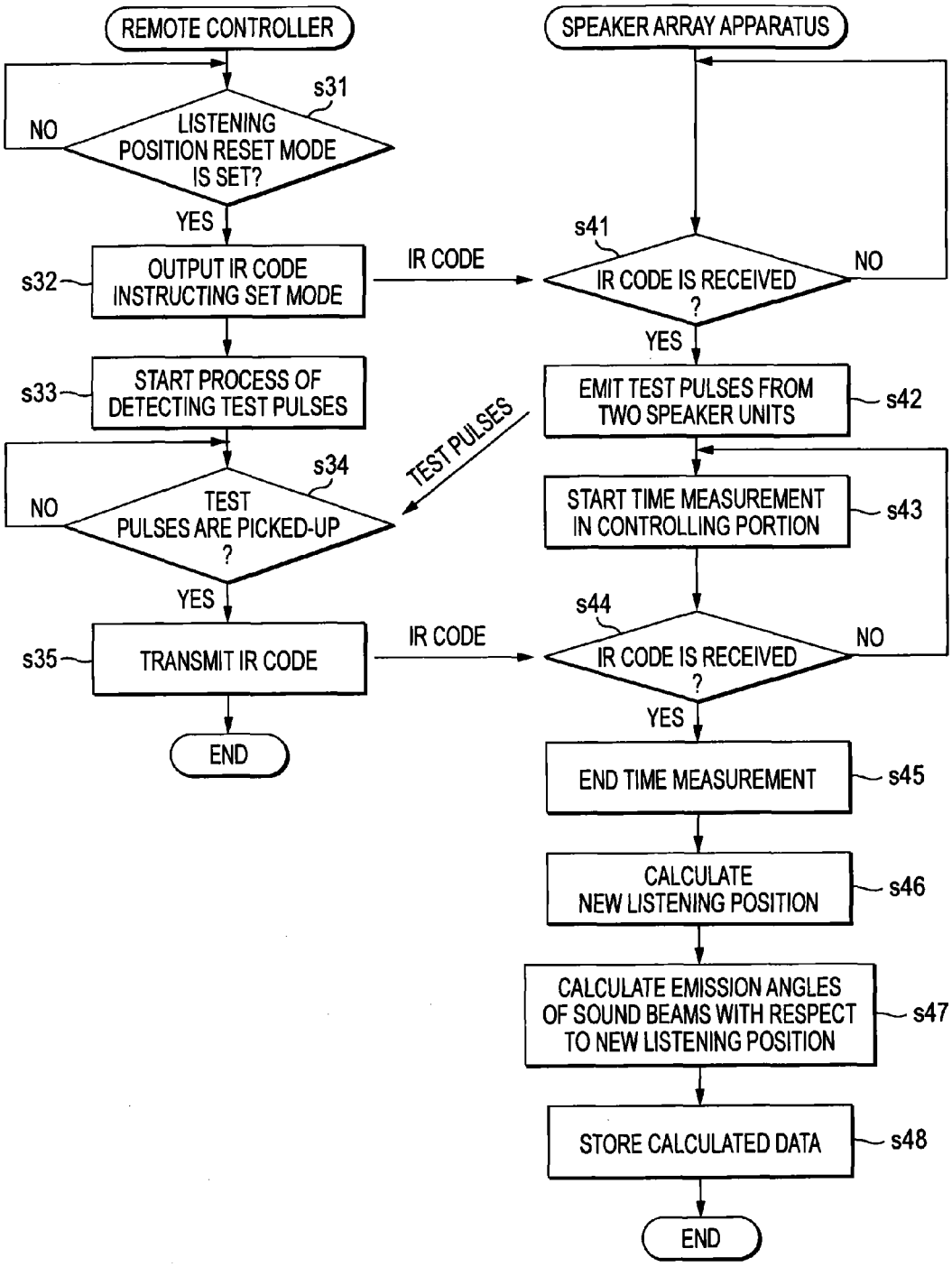
FIG. 6 is a flowchart illustrating the operation of again setting a listening position.
Figure 7A:
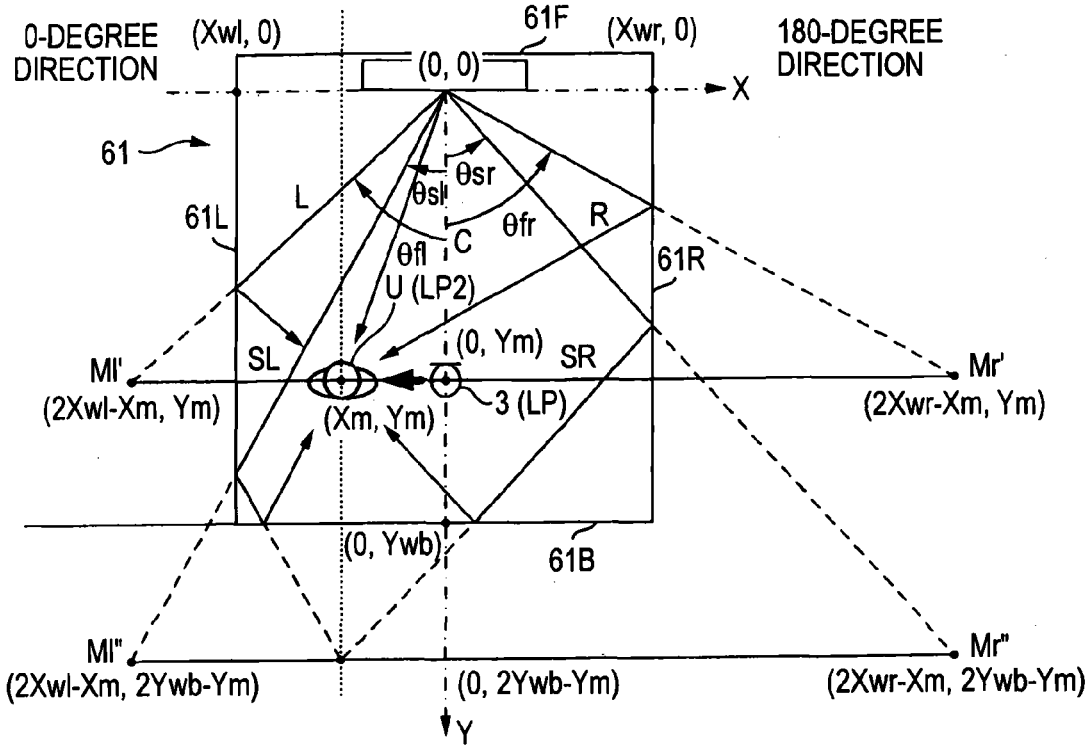
FIGS. 7A and 7B are views illustrating the procedure of a calculation in the case where the emission directions of sound beams are changed with respect to the changed listening position.
Figure 7B:
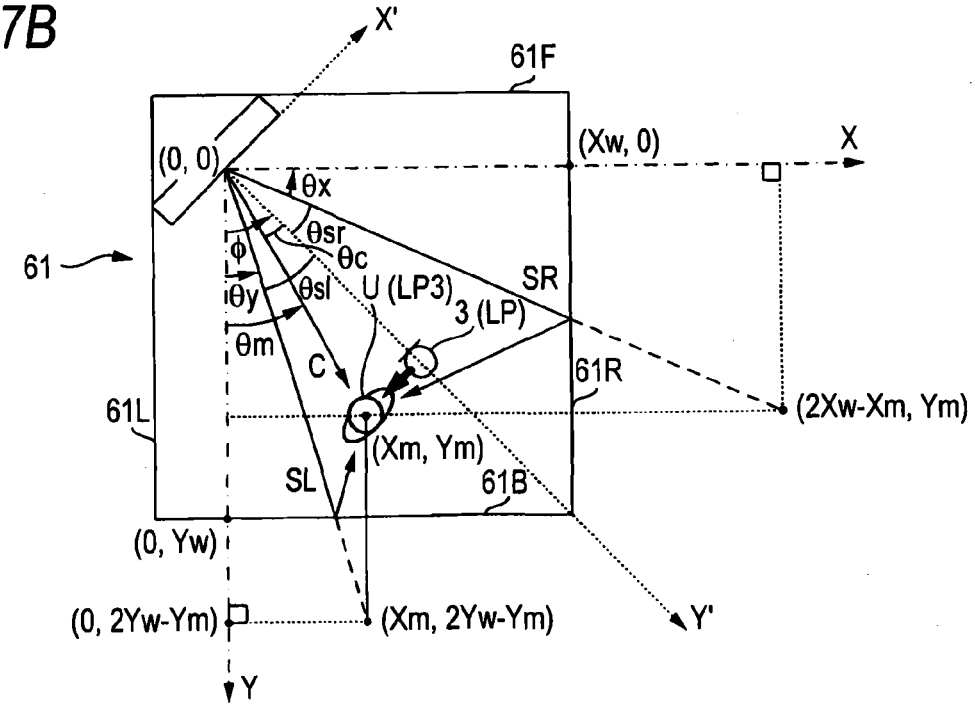

FIG. 6 is a flowchart illustrating the operation of again setting the listening position. FIGS. 7A and 7B are views illustrating the procedure of a calculation in the case where the emission directions of sound beams are changed with respect to the changed listening position, FIG. 7A shows the case of wall installation, and FIG. 7B shows the case of corner installation. Both the coordinates of the changed listening position LP2 shown in FIG. 7A, and those of the changed listening position LP3 shown in FIG. 7B are indicated by (Xm, Ym).

In the speaker array apparatus 1, when the listener changes the listening position, the listener operates the remote controller 5 to select a listening position reset mode, and the position of the remote controller 5 held by the listener is detected, whereby the emission directions of sound beams can be again set so as to form an optimum surround sound field at the changed listening position.

In the case where, as shown in FIG. 7A, the listener U moves from the listening position LP (0, Ym) where the microphone 3 is installed and the emission directions of sound beams are set, to a new listening position LP2 (Xm, Ym), the listener first operates the operating portion of the remote controller 5 to select the listening position reset mode.

When it is detected that the operating portion 49 is operated and the listening position reset mode is set (s31: Y), the controlling portion 51 of the remote controller 5 controls the IR-code transmitting portion 53 so as to output an IR signal instructing the listening position reset mode (s32), and sets the microphone 41 to a state where it can pick up test pulses (s33).

When the IR-signal receiving portion 39 receives the IR signal to detect that the listening position reset mode is set (s41: Y), the controlling portion 35 of the speaker array apparatus 1 causes the speaker units 27-1 and 27-N of the speaker array 27 to emit test pulses at different timings (s42). When the test pulses are emitted, the controlling portion 35 (the position detection processing portion 351) starts the time measurement (s43).

When the microphone 41 picks up the test pulses from the two speaker units (s34: Y), the controlling portion 51 of the remote controller 5 controls the IR-code transmitting portion 53 so as to immediately output an IR signal informing of the picks up of the test sounds (s35).

When the IR-signal receiving portion 39 receives the IR signal from the remote controller 5 (s44: Y), the controlling portion 35 (the position detection processing portion 351) of the speaker array apparatus 1 ends the time measurement (s45), and calculates the distance (installation position information) from the speaker array apparatus 1 to the changed listening position by the triangulation method with using the times from the emissions of the test sounds from the speaker units 27-1 and 27-N to the reception of the IR signal from the remote controller 5 (s46).

On the basis of information stored in the storage portion 33 such as the width and depth of the room 61, the manner of installing the speaker array apparatus 1 (wall installation or corner installation), and the distance from the left wall 61L to the speaker array 27, then, the controlling portion 35 controls the beam formation calculating portion 17 so as to calculate the emission directions of the sound beams of the channels so that the speaker array 27 emits the sound beams of the channels toward the changed listening position LP2 (LP3) (s47).

In the case where the speaker array apparatus 1 is wall-installed, for example, the followings are obtained as shown in FIG. 7A:

$$\theta fl=\tan^{-1}\{(2Xwl-Xm)/Ym\},$$

$$\theta sl=\tan^{-1}\{(2Xwl-Xm)/(2Ywb-Ym)\},$$

$$\theta fr=\tan^{-1}\{(2Xwr-Xm)/Ym\},$$

$$\theta sr=\tan^{-1}\{(2Xwr-Xm)/(2Ywb-Ym)\}.$$

As seen also from FIG. 5A, the emission direction of the C-ch is $$\theta c=\tan^{-1}(Xm/Ym).$$

From these expressions, the emission angles of the sound beams of the channels can be obtained.

In the case where the speaker array apparatus 1 is corner-installed, the followings are obtained as shown in FIG. 7B:

$$\theta x=\tan^{-1}\{Ym/(2Xw-Xm)\},$$

$$\theta y=\tan^{-1}\{Xm/(2Yw-Ym)\},$$

$$\theta m=\tan^{-1}(Xm/Ym).$$

Therefore, the followings are obtained:

$$\theta c=\theta m-\phi=tan^{-1}(Xm/Ym)-\phi,$$

$$\theta sr=90°-\theta x-\phi,$$

$$\theta sl=\phi-\theta y.$$

In the above expressions, θy is the angle formed by the Y-axis and the SL-ch sound beam, ϕ is the angle formed by the Y-axis and the Y'-axis, Ox is the angle formed by the X-axis and the SR-ch sound beam, θsl is the angle formed by the Y'-axis and the SL-ch sound beam, θsr is the angle formed by the Y'-axis and the SR-ch sound beam, θc is the angle formed by the Y'-axis and the C-ch sound beam, and θm is the angle formed by the X-axis and the C-ch sound beam.

In the speaker array apparatus 1, as described above, when the listening position is changed, the changed listening position is detected, and the emission angles of the sound beams are calculated and again set.

When the beam formation calculating portion 17 calculates the emission angles of the sound beams with respect to the changed listening position, the controlling portion 35 updates the information of the emission angles of the channels stored in the storage portion 33 (s48). Then, the controlling portion 35 ends the process.

In the speaker array apparatus 1, the listening position information is updated as described above. When the surround sound signal is input through the input terminal 11, therefore, the beam formation calculating portion 17 performs the calculation so that the sound beams are emitted toward the changed listening position LP2 (LP3) as shown in FIG. 7, on the basis of the installation position information stored in the storage portion 33 and the emission angle information of the channels which is updated based on the listening position information. On the basis of a result of the calculation, the phase controlling portion 21 performs setting so as to control the phases of sounds to be emitted from the speaker units. Therefore, the speaker array 27 emits sound beams of the channels toward the changed listening position, and hence an optimum surround sound field can be formed at the changed listening position.

In the above, the configuration in which, when the remote controller 5 is operated, the listening position can be again set in the virtual surround mode has been described. The invention is not restricted to this. A method such as that in which a magnetic sensor, an ultrasonic transmitter, an IR beacon, a radio transmitter, or the like is attached to the listener and the position of the listener is detected by the speaker array apparatus 1, or that in which the listener is found by a camera, a temperature sensor, or the like and the listening position is detected may be employed. According to the configuration, in the case where the listening position of the listener can be detected in real time, the controlling portion 35 calculates the emission angles of the sound beams, and the beam formation calculating portion 17 performs a calculation for forming a wavefront so as to attain the emission angles, on the basis of the detected listening position information, and the phase controlling portion 21 is controlled on the basis of results of the calculations, whereby the listening position can be changed (corrected) in real time. Therefore, the listener can freely change the listening position.

The present application is based on Japan Patent Application No. 2007-190835 filed on Jul. 23, 2007, the contents of which are incorporated herein for reference.

What is claimed is:

1. A speaker array apparatus comprising:

a speaker array having a plurality of speaker units arranged in an array;

a storage section that stores installation position information of the speaker array, the installation position information indicating a size of a room where the speaker array is installed and a distance from a wall of the room to the speaker array;

a position detecting section that detects a listening position of a listener;

a phase controlling section that controls phases of sounds to be emitted from the speaker units so that the speaker array emits sound beams of a plurality of channels, wherein the phase controlling section controls the phases of the sounds to be emitted from the speaker units on the basis of the installation position information and the listening position of the listener so that the speaker array emits the sound beams of the plurality of channels to form a surround sound field at the listening position of the listener;

an operating section that receives an initial setting operation;

a test sound outputting section that outputs a test sound signal and a phase control signal for controlling phases of the sounds emitted from the speaker units so that the speaker array emits a test sound beam while sweeping the test sound beam, when the operating section receives the initial setting operation;

a microphone that is locatable at a default listening position, and that picks up a sound of the test sound beam; and a controlling section that analyzes picked-up data of the test sound beam picked up by the microphone, calculates the size of the room and the distance from the wall of the room to the speaker array using a result of the analysis of the picked-up data and the listening position information indicating the listening position of the listener detected by the position detecting section, and stores the size of the room and the distance from the wall of the room to the speaker array into the storage section, wherein the operating section receives an operation for changing the listening position, wherein the controlling section controls the position detecting section to output the changed listening position when the operating section receives the operation for changing the listening position, and wherein the phase controlling section calculates to control the phases of the sounds emitted from the speaker units on the basis of the listening position information indicating the changed listening position, the size of the room, and the distance from the wall of the room to the speaker array stored in the storage section so that the phase controlling section controls the speaker array to emit sound beams of a plurality of channels to the changed listening position, and conducts a process to output a calculation result for controlling the phase of the sounds.

* * * * *